US010390121B2

(12) United States Patent
Kim

(10) Patent No.: US 10,390,121 B2
(45) Date of Patent: Aug. 20, 2019

(54) CHARGING STAND FOR HEADPHONES

(71) Applicant: Kum Oh Electronics CO., LTD., Bucheon-si (KR)

(72) Inventor: Ki Sang Kim, Bucheon-si (KR)

(73) Assignee: KUM OH ELECTRONICS CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/244,703

(22) Filed: Jan. 10, 2019

(65) Prior Publication Data

US 2019/0222916 A1 Jul. 18, 2019

(30) Foreign Application Priority Data

Jan. 12, 2018 (KR) ..... 10-2018-0004623

(51) Int. Cl.
*H04R 1/10* (2006.01)

(52) U.S. Cl.
CPC ..... *H04R 1/1025* (2013.01); *H04R 1/105* (2013.01); *H04R 1/1008* (2013.01)

(58) Field of Classification Search
CPC ..... H04R 1/1025; H04R 1/1008; H04R 1/105
USPC ..... 381/384
See application file for complete search history.

(56) References Cited

U.S. PATENT DOCUMENTS 5,095,382 A * 3/1992 Abe ..... H04B 10/114 320/107
8,494,205 B2 * 7/2013 Jensen ..... H02J 7/0044 320/107
8,593,573 B2 * 11/2013 Price ..... H04N 21/41 348/552
2005/0212479 A1 * 9/2005 Tsunoda ..... H02J 7/0044 320/114
2008/0049963 A1 * 2/2008 Mann ..... H02J 7/0044 381/384
2008/0119241 A1 * 5/2008 Dorogusker ..... H02J 7/0054 455/573

(Continued)

FOREIGN PATENT DOCUMENTS

KR 200234963 10/2001
KR 20050097590 10/2005

(Continued)

OTHER PUBLICATIONS http://blog.naver.com/hdswc0777/220846065871, Naver.
http://naver.me/GksevUaw, Naver.

*Primary Examiner* — Sean H Nguyen
(74) *Attorney, Agent, or Firm* — Cantor Colburn LLP

(57) ABSTRACT

Provided is a stand which is used for cradling headphones to be displayed in a store or the like. The headphones are charged in a state of being mounted on a cradle, and charging is stopped when the headphones are removed from the cradle, thus allowing the headphones to be used, while preventing the headphones from being stolen. The charging stand includes: a cradle having a cradling portion on which the headphones are cradled and a charging terminal provided adjacent to the cradling portion; and a charging cable having a holder provided with a connection terminal connected to the charging terminal, the holder holding the headphones, and a connection pin electrically connected to the connection terminal and connected to a charging port of the headphones.

3 Claims, 2 Drawing Sheets

(56) References Cited

U.S. PATENT DOCUMENTS

| | | | | |
|---|---|---|---|---|
| 2010/0137038 | A1* | 6/2010 | Scholz | H04R 1/1025<br>455/573 |
| 2011/0188677 | A1* | 8/2011 | Rothkopf | H02J 7/00<br>381/150 |
| 2013/0223640 | A1* | 8/2013 | Urano | H04R 1/1025<br>381/74 |

FOREIGN PATENT DOCUMENTS

| | | |
|---|---|---|
| KR | 101429394 | 8/2014 |
| KR | 101795557 | 11/2017 |

* cited by examiner

CHARGING STAND FOR HEADPHONES

BACKGROUND OF THE INVENTION

Field of the Invention

The present invention relates generally to a stand which is used for cradling headphones to be displayed in a store or the like. More particularly, the present invention relates to a charging stand for headphones, wherein the headphones are charged in a state of being mounted on a cradle, and charging is stopped when the headphones are removed from the cradle, thus allowing the headphones to be used, while preventing the headphones from being stolen.

Description of the Related Art

As well known in the art, headphones are a device that outputs audio signals of an audio device to a wearer's ears.

With development of communication technology and requirements for ease of use, a lot of headphones which wirelessly receive and output audio signals from an audio device have been increasingly used in recent years, and some headphones have a built-in audio device.

Wireless headphones which receive audio signals wirelessly or headphones with a built-in audio device have a built-in rechargeable battery.

In general, the functions of the headphones such as reception of audio signals, output of audio signals, and the like are stopped during charging.

Since the other functions are stopped during charging as described above, the following difficulties arise when displaying headphones in a store or the like.

Usually, various headphones are displayed in a store to allow visitors to try out the headphones. The headphones on display are connected to a charging device such that the headphones are prevented from being unusable due to discharging of the battery. In other words, a charging pin of the charging device is connected to a charging port of the headphones.

Accordingly, a visitor to a store has to remove the charging pin from the headphones before trying out the headphones. Additionally, some visitors use the headphones without removing the charging pin and thus complain to a store manager that the headphones does not work and check with the store manager and then remove the charging pin.

Furthermore, some visitors leave the headphones without connecting the charging pin to the charging port of the headphones after trying out the headphones.

This may cause a situation where the headphones that a visitor has left may be discharged and other visitors cannot use the headphones. To prevent this, the store manager has to check whether there are any headphones that the visitor has left after the visitor's visit.

For reference, in regard to rechargeable headphones, there are "RF headset unit" disclosed in Korean Patent Application Publication No. 10-2005-0097590, "Infrared transmitter and wireless headphones" disclosed in Korean Utility Model Registration No. 20-0234963, and the like.

However, there is no known charging stand for displaying and charging headphones in a state in which the headphones are cradled like the present invention. "Wireless charging device", which is disclosed in Korean Patent No. 10-1795557, relates to a charging device that wirelessly charges headphones without a charging port and a charging pin, and is not related to a stand.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been devised in order to solve the above problems involved in displaying rechargeable headphones in a store such that a visitor can try out the headphones, and an objective of the present invention is to provide a charging stand for headphones, wherein the headphones are charged in a state of being mounted on a cradle, thus being prevented from being discharged, and charging is stopped when the headphones are removed from the cradle, thus allowing the visitor to try out the headphones, whereby convenience of the visitor is enhanced when trying out the headphones, and convenience and efficiency of headphone management of a store manager are enhanced.

Another objective of the present invention is to provide a charging stand for headphones, wherein an anti-theft wire and an alarm are provided, thus preventing the headphones on display from being stolen.

In order to achieve the above objectives, according to one aspect of the present invention, there is provided a charging stand for headphones, the charging stand including:

a cradle having a cradling portion on which the headphones are cradled, a flat surface portion provided at a side of the cradling portion, and a charging terminal provided at the flat surface portion; and a charging cable having a holder and a connection pin, the holder being provided with a seat depression on which a headband portion of the headphones is seated, a supported portion formed at a side of the seat depression and placed on the flat surface portion, a connection terminal provided at the supported portion and connected to the charging terminal, and a clamper elastically holding an inner surface of the headband portion seated on the seat depression, and the connection pin being electrically connected to the connection terminal and connected to a charging port of the headphones.

The charging stand may further include an anti-theft wire withdrawn from a support of the cradle and having an end portion connected to the headphones.

The wire may be provided at the end portion thereof with a loop member adjusting a size of a loop surrounding an outer periphery of the headband portion of the headphones, and an alarm which outputs an alarm sound when the wire is cut or the size of the loop formed by the loop member is changed may be further provided.

The charging stand for headphones according to the present invention has the following effects: a situation in which the headphones cannot be used due to discharging can be prevented; a visitor can try out the headphones immediately without any operation (charging stop) after picking up the headphones from the cradle; a need for the store manager to frequently check the state of the headphones can be eliminated; and the headphones can be prevented from being stolen. Thus, the present invention is a product which is an extremely useful for industrial development.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
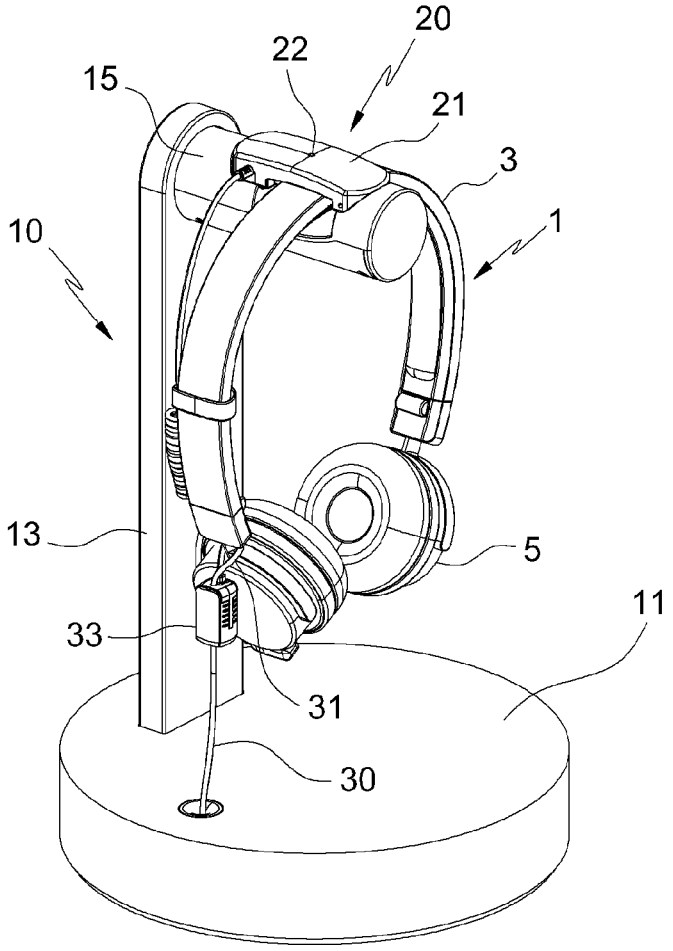
FIG. 1 is a perspective view showing a state in which headphones are cradled on a charging stand for headphones according to the present invention.
Figure 2:
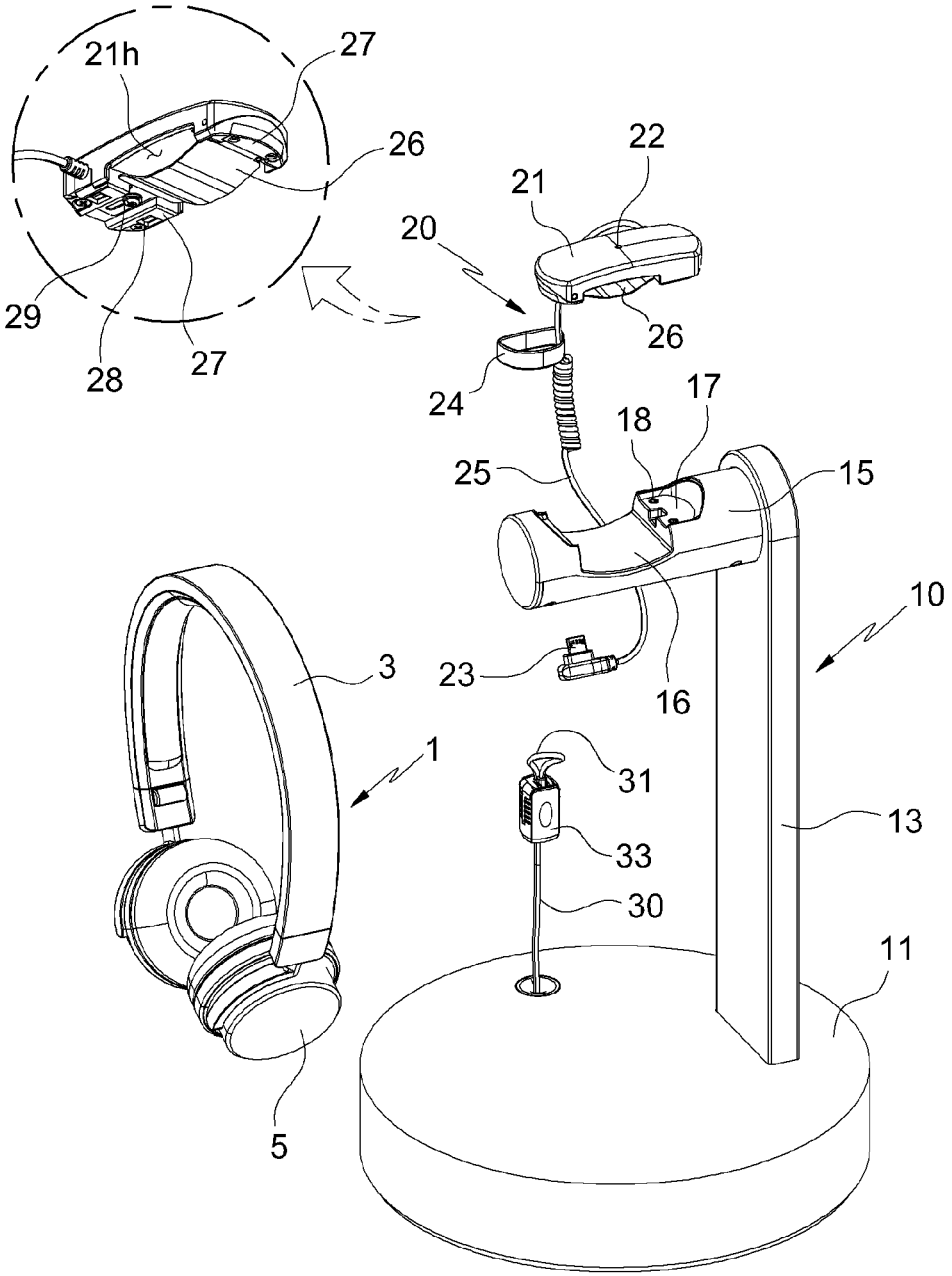
FIG. 2 is an exploded perspective view of FIG. 1.

Hereinbelow, exemplary embodiments of a charging state for headphones according to the present invention will be described in detail with reference to the accompanying drawings. Prior to describing the charging stand for headphones according to the present invention in more detail, the present invention will now be described in detail based on aspects (or embodiments). The present invention may, however, be embodied in many different forms and should not be construed as being limited to only the embodiments set forth herein, but should be construed as covering modifications, equivalents or alternatives falling within ideas and technical scopes of the present invention.

In the figures, like reference numerals, particularly, tens and units, or reference numerals having like tens, units and letters refer to like elements having like functions throughout, and unless the context clearly indicates otherwise, elements referred to by reference numerals of the drawings should be understood based on this standard.

Also, for convenience of understanding of the elements, in the figures, sizes or thicknesses may be exaggerated to be large (or thick), may be expressed to be small (or thin) or may be simplified for clarity of illustration, but due to this, the protective scope of the present invention should not be interpreted narrowly.

The terminology used herein is for the purpose of describing particular aspects (or embodiments) only and is not intended to be limiting of the present invention. As used herein, the singular forms are intended to include the plural forms as well, unless the context clearly indicates otherwise. It will be further understood that the terms "comprises", "comprising", "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present invention belongs. It will be further understood that terms used herein should be interpreted as having a meaning that is consistent with their meaning in the context of this specification and the relevant art and will not be interpreted in an idealized or overly formal sense unless expressly so defined herein.

As shown in the drawings, a charging stand for headphones according to the present invention is roughly divided into a cradle 10, a charging cable 20, and an anti-theft wire 30.

The cradle 10 is a mechanism on which the headphones are cradled to be displayed.

The cradle 10 includes a support 11 placed on a surface, a post 13 vertically extending from the support 11, and a cradling arm 15 horizontally extending from an upper portion of the post 13.

The cradling arm 15 has a cradling portion 16 formed in an upper side thereof and on which a headband portion 3 of the headphones 1 is cradled. The cradling portion 16 has a depression structure rounded correspondingly to the shape of the headband portion 3 such that the headband portion 3 of the headphones 1 is seated and cradled thereon.

The cradling portion 16 has opposite sides each provided with a flat surface portion 17, and the flat surface portion 17 formed at one of the opposite sides of the cradling portion is provided with a charging terminal 18. The charging terminal 18 supplies electric power for charging the headphones 1.

It is preferable that the charging terminal 18 has a protrusion structure and is configured to be elastically supported inside the flat surface portion to be insertable and withdrawable, such that the charging terminal 18 is brought into close contact with a connection terminal 28 of a holder 21 of the charging cable 20.

The charging cable 20 includes the holder 21, a connection pin 23, and a wire 25 electrically connecting the holder and the connecting pin to each other.

The holder 21 holds the headband portion 3 of the headphones 1, and the connection pin 23 is connected to a charging port provided at an earpiece portion 5 of the headphones 1.

The holder 21 has a seat depression **21*h* formed in a lower surface thereof and on which the headband portion 3 of the headphones 1 is seated. The seat depression 21*h* is provided with a clamper 26 elastically holding an inner surface of the headband portion 13 of the headphones 1** being seated.

The seat depression **21*h* has opposite sides each provided with a supported portion 27 supportedly placed on the flat surface portion 17 of the cradle 10. Furthermore, the supported portion 27 formed at one of the opposite sides of the seat depression is provided with the connection terminal 28 connected to the charging terminal 18 and a power switch 29** shutting off unnecessary power supply after charging of the headphones is completed.

The connection terminal 28 is supplied with electric power via the charging terminal 18 and supplies the supplied electric power to a battery built in the earpiece portion 5 of the headphones 1 via the connection pin 23 and the charging port to charge the battery.

The holder 21 is provided on an upper surface thereof with a power-indicating LED lamp 22 for checking whether the electric power supplied to the connection terminal 28 is supplied to the battery via the connection pin 23.

To prevent the charging cable 20 from being separated from the headphones 1 and falling off a surface, thus being damaged, stolen, or lost, it is preferable that the wire 25 of the charging cable 20 is tied to the headband portion 3 of the headphones 1 by a member 24 such as a rubber ring.

The anti-theft wire 30 is connected to the headphones 1 to prevent the headphones 1 from being moved outside the length range of the wire 30, thus preventing the headphones 1 from being stolen.

The anti-theft wire 30 is withdrawn from the support 11 of the cradle 10. The wire 30 may be built in the support 11 in a state of being wound like a spring so as to be inserted into and withdrawn from the support 11 or may be provided at an inner side of a display table (not shown), the display table on which the support 11 is mounted, in a state of being wound like a spring by passing through the support 11 so as to be inserted into and withdrawn from the support 11.

The anti-theft wire 30 has a loop 31 formed at an end portion thereof and surrounding the outer periphery of the headband portion 3 of the headphones 1. The wire 30 is provided at the end portion thereof with a loop member 33 such that the loop 31 formed by the wire 30 is adjustable in size. The loop 31 is increased in size to pass over the earpiece portion 5 of the headphones 1 and is then decreased in size, thus being fastened to the headphones 1.

If the anti-theft wire 30 is cut or the size of the loop 31 is arbitrarily changed, a theft of the headphones 1 may be attempted. In this case, an alarm detects this and outputs an alarm sound, thus preventing the headphones 1 from being stolen.

The anti-theft wire 30 is comprised of a metal cable which is not easily cut and a power line through which electric power flows and is connected to the alarm. Accordingly, when the wire 30 is cut (that is, the power line is cut) and thus the electric power does not flow, or when the size of the loop is changed and thus the resistance of the power line is changed, the alarm detects this.

Although the exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A charging stand for headphones, the charging stand comprising:

a cradle having a cradling portion on which the headphones are cradled, a flat surface portion provided at a side of the cradling portion, and a charging terminal provided at the flat surface portion; and a charging cable having a holder and a connection pin, the holder being provided with a seat depression on which a headband portion of the headphones is seated, a supported portion formed at a side of the seat depression and placed on the flat surface portion, a connection terminal provided at the supported portion and connected to the charging terminal, and a clamper elastically holding an inner surface of the headband portion seated on the seat depression, and the connection pin being electrically connected to the connection terminal and connected to a charging port of the headphones.

2. The charging stand of claim 1, further comprising:

an anti-theft wire withdrawn from a support of the cradle and having an end portion connected to the headphones.

3. The charging stand of claim 2, wherein the wire is provided at the end portion thereof with a loop member adjusting a size of a loop surrounding an outer periphery of the headband portion of the headphones, and an alarm which outputs an alarm sound when the wire is cut or the size of the loop formed by the loop member is changed is further provided.

* * * * *